US011913727B2

(12) United States Patent
Qi et al.

(10) Patent No.: US 11,913,727 B2
(45) Date of Patent: Feb. 27, 2024

(54) FLAT HEAT PIPE HAVING A GRADIENT WETTING STRUCTURE

(71) Applicant: Xi'an Jiaotong University, Shaanxi (CN)

(72) Inventors: Baojin Qi, Shaanxi (CN); Jinjia Wei, Shaanxi (CN); Ya Wang, Shaanxi (CN); Ting Yu, Shaanxi (CN); Chenyi Cui, Shaanxi (CN)

(73) Assignee: Xi'an Jiaotong University, Xi'an (CN)

( * ) Notice: Subject to any disclaimer, the term of this patent is extended or adjusted under 35 U.S.C. 154(b) by 390 days.

(21) Appl. No.: 17/326,367

(22) Filed: May 21, 2021

(65) Prior Publication Data

US 2021/0278141 A1 Sep. 9, 2021

Related U.S. Application Data

(63) Continuation of application No. PCT/CN2018/119423, filed on Dec. 5, 2018.

(30) Foreign Application Priority Data

Nov. 23, 2018 (CN) ..... 201811413366.6

(51) Int. Cl.

| | |
|---|---|
| ***F28D 15/04*** | (2006.01) |
| ***F28D 15/02*** | (2006.01) |
| ***F28F 13/00*** | (2006.01) |

(52) U.S. Cl.

CPC ..... *F28D 15/046* (2013.01); *F28D 15/0233* (2013.01); *F28F 13/003* (2013.01); *F28F 2245/02* (2013.01); *F28F 2245/04* (2013.01); *F28F 2255/00* (2013.01); *F28F 2255/18* (2013.01); *F28F 2260/02* (2013.01); *F28F 2275/06* (2013.01)

(58) Field of Classification Search

CPC .. F28D 15/046; F28D 15/0233; F28F 13/003; F28F 2245/02; F28F 2245/04; F28F 2255/00; F28F 2255/18; F28F 2260/02; F28F 2275/06

USPC ..... 165/104.26

See application file for complete search history.

(56) References Cited

U.S. PATENT DOCUMENTS

2010/0033933 A1* 2/2010 Hashimoto ..... F28D 15/0233 165/104.21

FOREIGN PATENT DOCUMENTS

| | | | |
|---|---|---|---|
| CN | 105222629 | A | 1/2016 |
| CN | 107640739 | A | 1/2018 |
| CN | 108444324 | A | 8/2018 |

OTHER PUBLICATIONS

International Search Report of PCT Patent Application No. PCT/CN2018/119423 dated Aug. 20, 2019.

* cited by examiner

*Primary Examiner* — Joel M Attey

(57) ABSTRACT

The present invention discloses a flat heat pipe, comprising a bottom plate, a top plate, and a support plate located between the bottom plate and the top plate; a micron-level radial strip is processed on the inner surface of the bottom plate; the inner surface of the top plate is processed with superhydrophilic and superhydrophobic radial structures arranged at intervals to transport the condensate to the direction of the surrounding pipe wall; a wick is arranged on the inner side of the support plate. The present invention has the function of pumpless directional transport of liquid and convergence of refluxed condensate; thereby improving the heat exchange performance of the entire flat heat pipe.

10 Claims, 7 Drawing Sheets

FLAT HEAT PIPE HAVING A GRADIENT WETTING STRUCTURE

CROSS REFERENCE TO RELATED APPLICATIONS

The present application is a Continuation Application of PCT Application No. PCT/CN2018/119423 filed on Dec. 5, 2018, which claims the benefit of Chinese Patent Application No. 201811413366.6 filed on Nov. 23, 2018. All the above are hereby incorporated by reference in their entirety.

FIELD OF THE INVENTION

The present invention generally relates to the technical field of heat dissipation devices of electronic components, and specifically relates to a flat heat pipe having a gradient wetting structure.

BACKGROUND

With the rapid development of electronic technology, electronic components are gradually developing towards miniaturization, high-speed and high-frequency, and high integration. Their functions are becoming more and more complicated and their heat flux of heat dissipation is getting higher and higher, resulting in an increase in the failure rate of electronic equipment. Therefore, to achieve efficient heat dissipation of electronic components and ensure their reliability have become the technical difficulties and research hotspots.

Flat heat pipes are efficient phase change heat-transfer equipment by modifying conventional heat pipes, with the advantages of simple structure, good temperature uniformity and efficient heat transfer. It is mainly composed of a shell, a wick and a working fluid, etc. Its working principle is similar to ordinary heat pipe, that is, removing the heat of electronic components by virtue of phase change latent heat of working fluid. When the heat passes through the evaporation zone of the flat heat pipe from the heat source, the liquid working fluid boils and vaporizes in the low-vacuum airtight chamber, and the gas is forced to the condensation zone due to the pressure difference, the gas on the condensation surface condensates and releases heat, and reflows along the wick to the evaporation zone under the action of capillary force. On the evaporation surface, the phase change of the working fluid takes away the heat of the heat source, and on the condensing surface, the heat is taken away by other heat dissipation methods outside the flat heat pipe. Compared to the ordinary heat pipes, the flat heat pipe upgrades one-dimensional heat transfer to two-dimensional mode, with better temperature uniformity.

However, the existing flat heat pipes mainly rely on the capillary force provided by the wick to promote the reflux of the working fluid. Since both the evaporating surface and the condensation surface are covered with wicks and the wicks of the porous structure have a large thermal resistance, it increases the heat transfer resistance of the entire heat pipe. In addition, the sintered wick structure itself requires energy consumption and the sintering quality is difficult to be guaranteed.

SUMMARY

In order to overcome the shortcomings of the prior art, it is an object of the present invention to provide a flat heat pipe having a gradient wetting structure. The flat heat pipe has a reasonable structural design. It utilizes the combined action of surface tension and capillary force to guide and accelerate the reflux rate of the working fluid, furthermore, the coverage of wicks and the heat transfer resistance are reduced to enhance the overall heat transfer capability.

In order to achieve the above object, the present invention adopts the following technical solutions:

The present invention discloses a flat heat pipe having a gradient wetting structure, comprising a bottom plate, a top plate, and a support plate located between the bottom plate and the top plate, there are two support plates, and the bottom plate, the top plate and support plates on both sides are connected to form a seal chamber;

A micron-level radial strip is processed on the inner surface of the bottom plate, presenting a wetting gradient that changes uniformly from the center to the circumference of a circle, which is used to transport liquid and collect condensate without a pump in the direction of the center of the circle;

The inner surface of the top plate is processed with superhydrophilic and superhydrophobic radial structures arranged at intervals to transport the condensate to the direction of the surrounding pipe wall;

A wick is arranged on the inner side of the support plate, to transfer the liquid from the edge of the top plate to the edge of the bottom plate.

Preferably, the wick is sintered on the inner side of the support plate by powder, and is a porous structure; the upper and lower ends of the wick are connected to the top plate and the bottom plate respectively.

Preferably, the flat heat pipe further comprises a plurality of support columns arranged between the bottom plate and the top plate, wherein the upper and lower ends of the support columns are connected to the top plate and the bottom plate respectively.

Further preferably, the plurality of support columns is uniformly distributed between the bottom plate and the top plate.

Preferably, the bottom plate, the top plate and the support plate are connected by welding and sealing.

Preferably, the area of the superhydrophobic zone is larger than the area of the superhydrophilic zone in the radial structure of the inner surface of the top plate; further, the ratio of surface area of superhydrophilic zone to the superhydrophobic zone is 1:5.

Preferably, the height of the convex micron-level radial strip on the inner surface of the bottom plate and the distance between adjacent micron-level radial strips meet the requirement of being capable of holding up droplets to ensure a Cassie-Baxter state of the surface.

Preferably, the micron-level radial strip on the inner surface of the bottom plate is prepared by photolithography.

Compared to the prior art, the present invention has the following beneficial effects.

For the flat heat pipe having a gradient wetting structure of the present invention, on the one hand, the bottom plate is the evaporation surface of the flat heat pipe, and its inner surface is processed with micron-level radial strips, and the droplets can exhibit a Cassie-Baxter wetting model on the surface, therefore it has a uniformly changing wetting gradient, and the wettability gradually increases from the outer side to the inner side of the circumference. This structure has the function of pumpless directional transport of liquid and convergence of condensate, which facilitates to concentrate the refluxed condensate at the heat source and accelerate the supply rate of working fluid on the evaporation surface. On the other hand, the inner surface of the top plate is processed with superhydrophilic and superhydrophobic radial pattern structures arranged at intervals. The superhydrophobic zone is provided with a condensation nucleation zone, and all of them are drop-shaped condensations, which reduces the heat transfer resistance and greatly enhances the heat transfer efficiency. The superhydrophilic zone has the ability to transport condensates to the surrounding pipe wall under the action of surface tension, which accelerates the circulation speed of the working fluid. Thus, for the flat heat pipe of the present invention, by processing and modification of the top plate and bottom plate, the sintering of the wicks is reduced, the evaporation and condensation speed is enhanced while ensuring the reflux speed of the working fluid, and the heat transfer resistance is reduced, the heat transfer performance of the evaporation zone and the condensation zone is improved, thereby improving the overall heat transfer capability of the flat heat pipe.

Further, a plurality of support columns whose both ends are in contact with the bottom plate and the top plate respectively are uniformly arranged in the airtight chamber of the flat heat pipe, to prevent the surface of the flat heat pipe from being deformed.

Further, taking the silicon substrate as an example, the surface structure of the bottom plate is prepared by photolithography. The convex radial micron-scale strips on the surface are prepared by photolithography. Particularly, in order to ensure a stable Cassie-Baxter state on the surface, the height of the convex micron-scale strips should be enough and the distance between strips should be small enough to hold up the droplets, and the hydrophobicity of the surface should also be ensured.

BRIEF DESCRIPTION OF THE DRAWINGS

FIG. 4-1 is a schematic diagram of the Cassie model of the gradient wetting structure of the bottom plate surface;

FIG. 4-2 is a schematic diagram of the proportion model of solids on the surface of the bottom plate;

FIG. 4-3 is a schematic diagram showing the principle of droplet movement direction;

FIG. 5-1 is a model diagram of water droplets on a wedge-shaped super-hydrophilic trajectory;

FIG. 5-2 is a mechanical model diagram showing the force on the water droplets during the spontaneous movement.

Notes: 11—bottom plate; 12—top plate; 13—support plate; 14—wick; 15—support column.

DETAILED DESCRIPTION

In order to enable those skilled in the art to better understand the solutions of the present invention, the technical solutions in the embodiments herein will be described explicitly and completely in conjunction with the accompanying drawings in the embodiments. Apparently, the described embodiments are only a part of embodiments of the present invention, not all the embodiments. All other embodiments obtained by those of ordinary skill in the art without creative work based on the embodiments herein shall fall within the scope of protection of the present invention.

It should be noted that the terms "first", "second" as used in the specification and claims of the present invention and attached drawings are used to distinguish similar objects, and are not necessarily used to describe a specific sequence or order. It should be understood that these figures used in this way can be interchanged under appropriate circumstances so that the embodiments of the present invention described herein can be implemented in a sequence other than those illustrated or described herein. In addition, the terms "comprise", "include", "have" and any variations of them are intended to cover non-exclusive inclusions. For example, a process, method, system, product, or device that includes a series of steps or units is not necessarily limited to those that are clearly listed steps or units, but may include other steps or units that are not clearly listed or are inherent to these processes, methods, products, or equipment.

The present invention will be further described in detail below in conjunction with the accompanying drawings.

Figure 1:
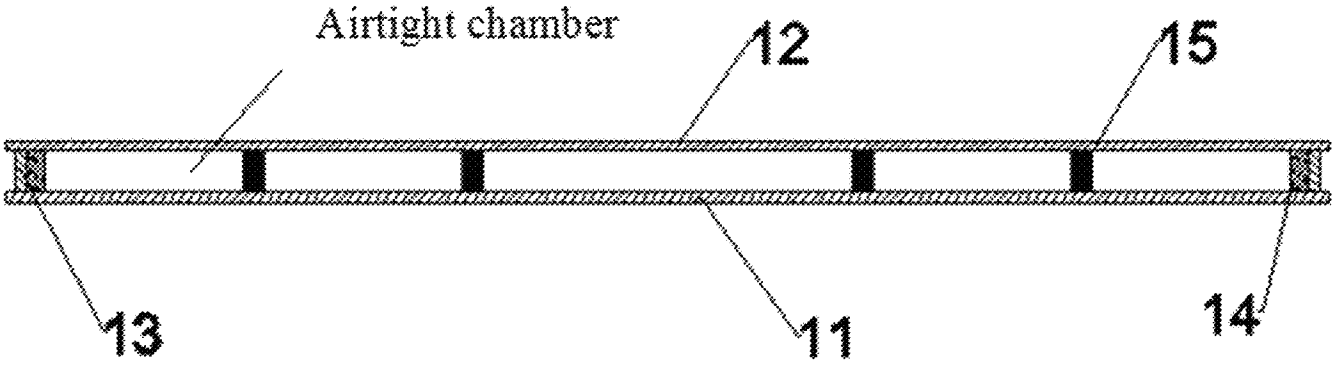
FIG. 1 is a front sectional view of a flat heat pipe having a gradient wetting structure of the present invention.

As shown in FIG. 1, a flat heat pipe having a gradient wetting structure of the present invention comprises a bottom plate 11, a top plate 12, and a support plate 13 located between the top plate and the bottom plate, and the bottom plate 11, the top plate 12, and the support plate 13 are connected in a sealed manner to form a seal chamber; a micron-level radial strip is processed on the inner surface of the bottom plate 11 as the evaporation surface of the flat heat pipe, presenting a wetting gradient that changes uniformly, the structure has the function of pumpless directional transport of liquid and collection of condensates; The inner surface of the top plate 12 as a condensation surface of the flat heat pipe is processed with superhydrophilic and superhydrophobic radial structures arranged at intervals, to transport the condensate to the direction of the surrounding pipe wall.

A wick 14 is arranged on the inner side of the support plate 13. The wick 14 with porous structure is sintered on the inside of plate 13. The upper and lower ends of the wick 14 respectively connect with the roof 12 and the floor 11.

The present invention preferably comprised several supporting columns 15 which are setting between the roof 12 and the floor 11. The upper and lower ends of the columns 15 respectively connect with the roof 12 and the floor 11.

Further preferably, the several supporting columns 15 distribute uniformly between the roof 12 and the floor 11. The support plate 13, the roof 12 and the floor 11 are connected closely using welding.

Figure 2:
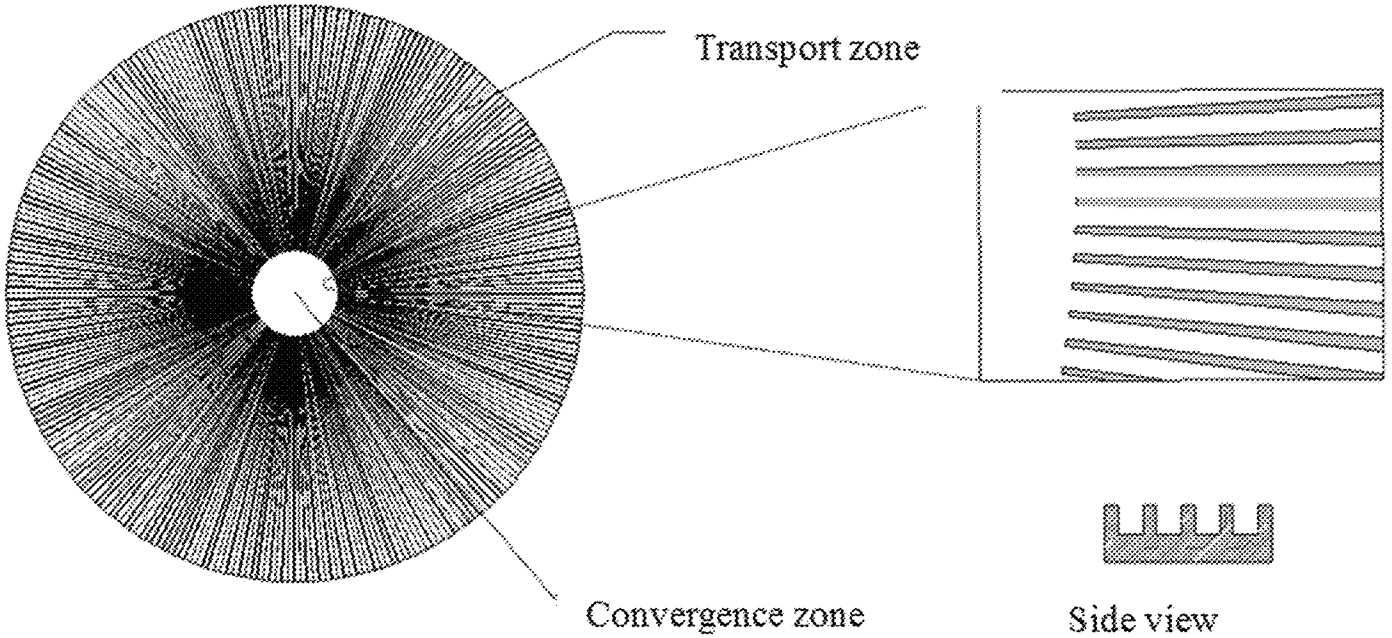
FIG. 2 is a top view of a bottom plate of a flat heat pipe having a gradient wetting structure of the present invention.

The present invention is a flat heat pipe suitable for heat dissipation of electronic components. The bottom plate 11 is an evaporation surface of the flat heat pipe, as shown in FIG. 2, a micron-level radial strip is processed on the inner surface of the bottom plate, and the droplets exhibit a Cassie-Baxter wetting model on the surface, with a uniformly changing wetting gradient, and the wettability gradually increases from the outer side to the inner side of the circumference. Therefore, the structure has the function of pumpless directional transport of liquid and convergence of condensate, which facilitates to concentrate the refluxed condensate at the heat source and accelerate the supply rate of working fluid on the evaporation surface.

Figure 3:
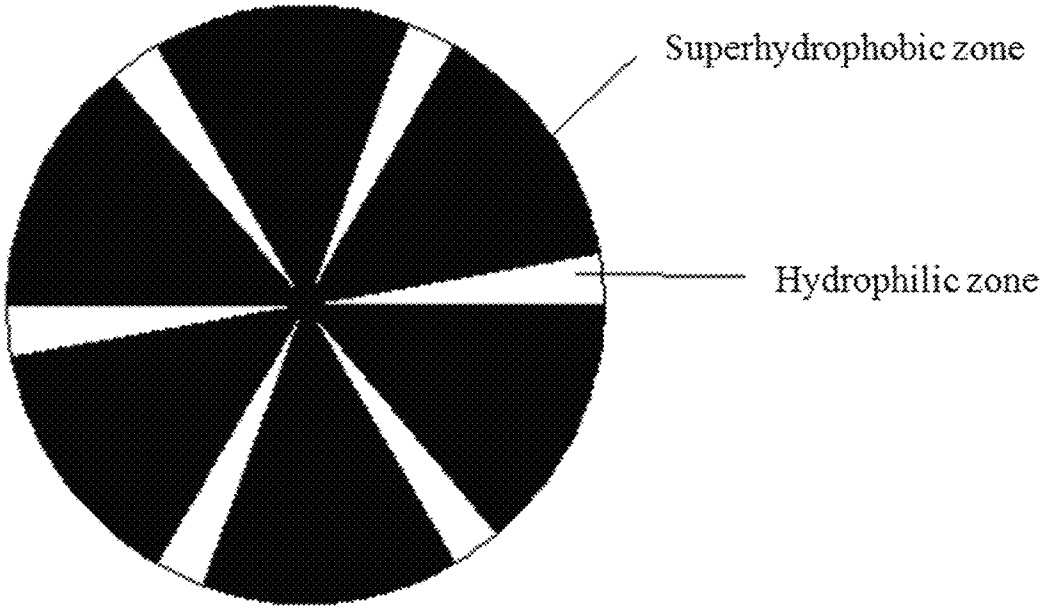
FIG. 3 is a top view of a top plate of a flat heat pipe having a gradient wetting structure of the present invention.

As shown in FIG. 3, the inner surface of the top plate is processed with superhydrophilic and superhydrophobic radial pattern structures arranged at intervals. The superhydrophobic zone is provided with a condensation nucleation zone, and all of them are drop-shaped condensations, which reduces the heat transfer resistance and greatly enhances the heat transfer efficiency. The superhydrophilic zone has the ability to transport condensates to the surrounding pipe wall under the action of surface tension, which accelerates the circulation speed of the working fluid. Thus, for the flat heat pipe of the present invention, by processing and modification of the top plate and bottom plate, the sintering of the wicks is reduced, the evaporation and condensation speed is enhanced while ensuring the reflux speed of the working fluid, and the heat transfer resistance is reduced, the heat transfer performance of the evaporation zone and the condensation zone is improved, thereby improving the overall heat transfer capability of the flat heat pipe.

Preferably, an area of a superhydrophobic zone is larger than the area of the superhydrophilic zone in the radial structure of the inner surface of the top plate 12; a ratio of surface area of superhydrophilic zone to the superhydrophobic zone is 1:5.

The advantages of the modified design of the bottom plate of the present invention will be described in conjunction with the mechanism of the gradient wetting structure on the surface of the bottom plate.

Figures 1, 4:
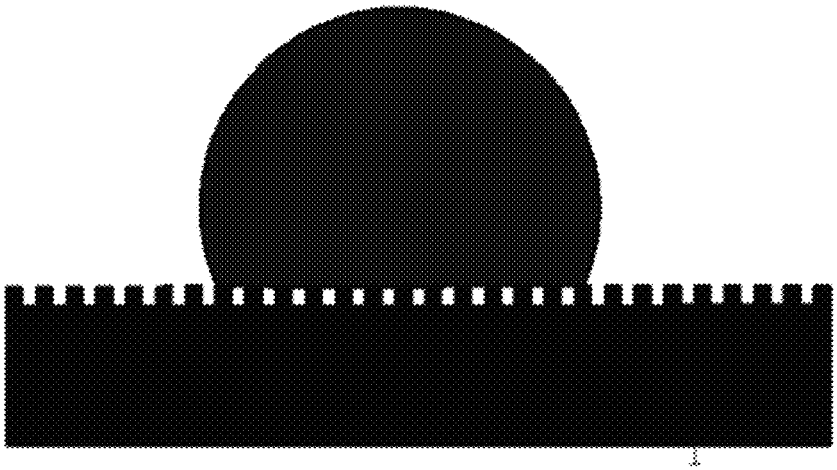
Figures 2, 4:
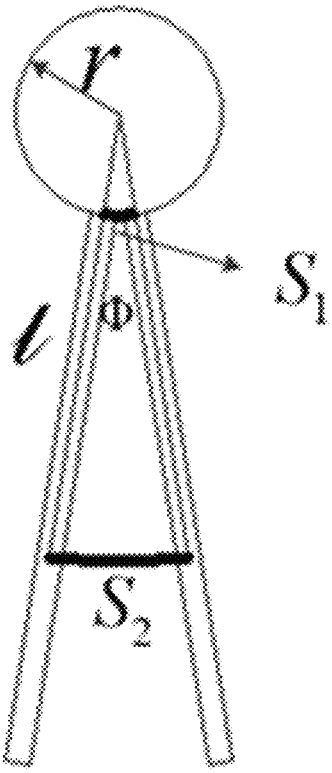
Figures 3, 4:
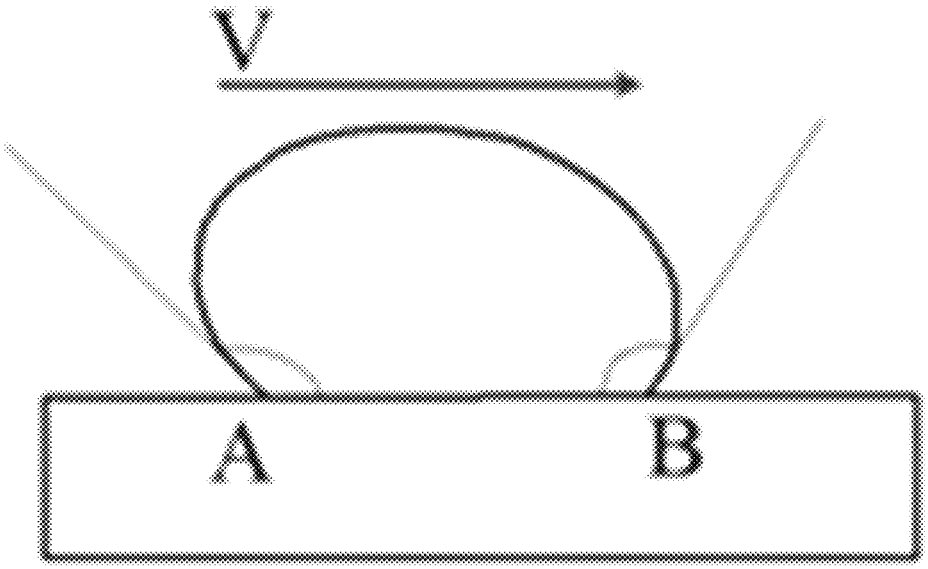

As shown in the Cassie model in FIG. 4-1, the Cassie-Baxter equation is $\cos\theta = f_1 \cos\theta_0 - (1 - f_1)$;

Where, f1 is the surface ratio of the solid, θ0 is the intrinsic contact angle, and θ is the apparent contact angle;

As shown in FIG. 4-2, the proportion of solids on the surface can be calculated as:

$$f_1(l) = \frac{S_1}{S_2} = \frac{r\varphi}{l\varphi} = \frac{r}{l};$$

$$\cos\theta(l) = \frac{r\cos\theta_0}{l} - \left(1 - \frac{r}{l}\right);$$

$$\theta(l) = \arccos\left[r(1 + \cos\theta_0)/l - 1\right];$$

θ∈, cos θ is a monotonous decreasing function. When l decreases, cos θ increases and θ decreases. The smaller the l is, the more hydrophilic the surface.

As shown in FIG. 4-3, $\theta_B < \theta_A$, the direction of droplet movement is A→B, so the droplets converge in the middle.

The advantages of the modified design of the top plate of the present invention will be described in conjunction with the droplets transport mechanism of the top plate.

Figures 1, 5:
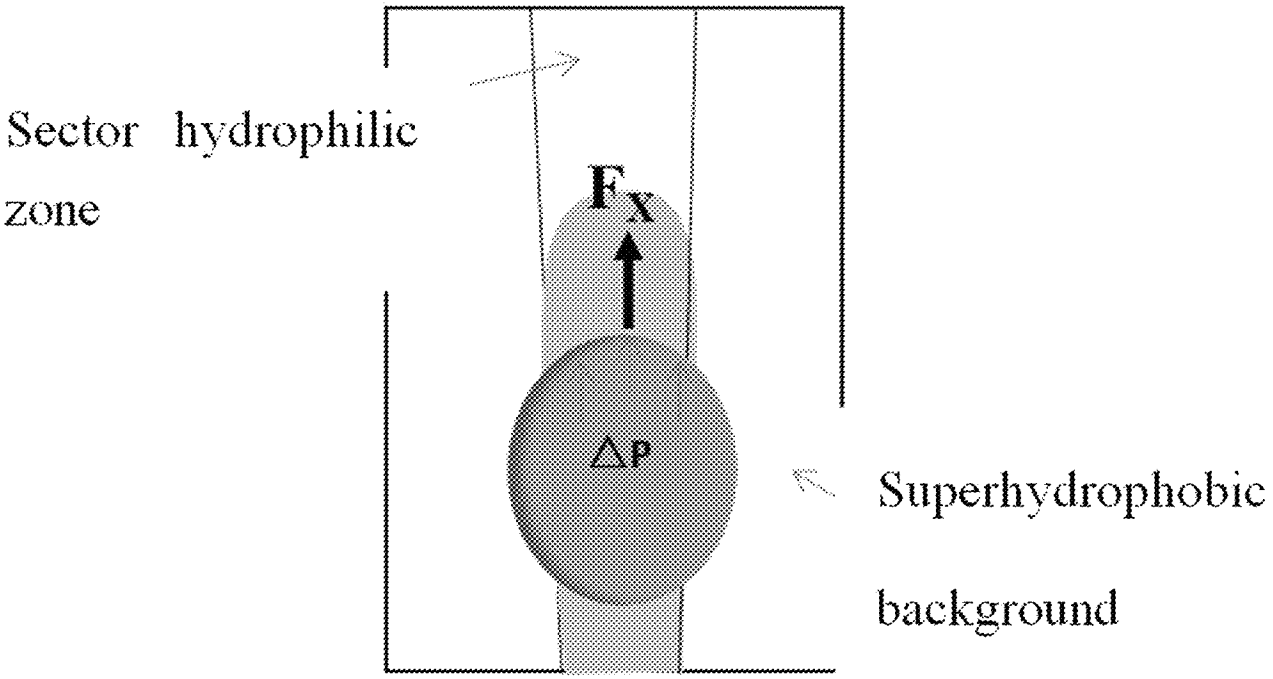
Figures 2, 5:
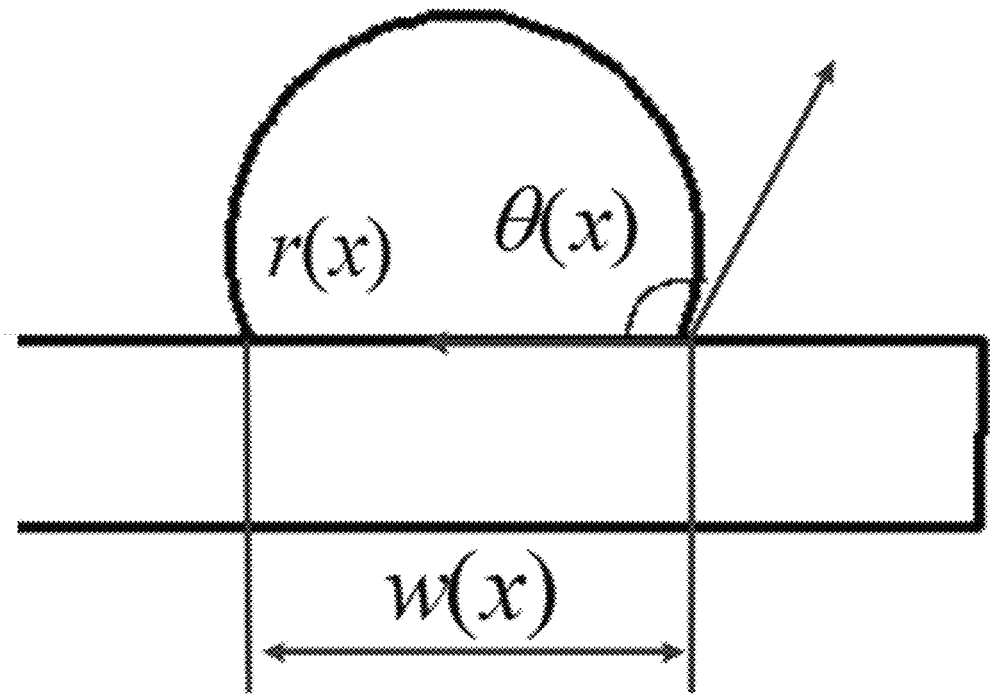

The model of water droplets on a wedge-shaped superhydrophilic trajectory is shown in FIG. 5-1. A single water droplet can be divided into a liquid convex part and a liquid front end during transport. Under the action of Laplace force, the water droplets move spontaneously. The force is simplified to the mechanical model shown in FIG. 5-2. The difference ΔP of the Laplace force of the water droplet in the x direction is proportional to $\gamma_{LG}/r(x)$, where $\gamma_{LG}$ is the interfacial tension between water and air, and r(x) is the radius of curvature of the water droplet, which can be estimated by the following formula:

$$r(x) \approx \frac{w(x)}{2\sin[\theta(x)]}$$

$$W(x) = \frac{a}{2} + x\tan\frac{\alpha}{2}$$

Where, w(x) is the width of the super-hydrophilic trajectory, θ(x) is the contact angle of the water droplet, and a is the initial width of the super-hydrophilic trajectory of the wedge-shaped structure. Therefore, the difference ΔP of Laplace force can be calculated by the following formula:

$$\Delta p \sim \frac{\gamma LG}{r(x)} \approx 4\gamma LG\frac{\sin[\theta(x)]}{a + 2x\tan\frac{\alpha}{2}}$$

The resultant force of the water droplet in the x direction is $F_x = \Delta P \cdot S_x$, where Sx is the cross-sectional area in the x direction. Assuming that the cross-sectional area is part of a circular cross-section, then Sx is proportional to $\pi r^2(x)$.

$$F_x = \Delta p \cdot S(x) \sim \pi\gamma_{LG}\frac{a + 2x\tan\frac{\alpha}{2}}{4\sin[\theta(x)]}$$

$F_x$ is proportional to tan(α/2) and inversely proportional to sin[θ(x)].

In summary, for the flat heat pipe having a gradient wetting structure of the present invention, a micron-level radial strip is processed on the inner surface of the bottom plate as the evaporation surface of the flat heat pipe, presenting a wetting gradient that changes uniformly, the structure has the function of pumpless directional transport of liquid and collection of condensates; The inner surface of the top plate as a condensation surface of the flat heat pipe is processed with superhydrophilic and superhydrophobic radial structures arranged at intervals, to transport the condensate to the outside; a wick structure is arranged on the inner side of the support plate. The flat heat pipe adopts micro-nano processing on the evaporation surface to make it have the function of pumpless directional transport of liquid and convergence of refluxed condensate; the patterned superhydrophilic and superhydrophobic processing of the condensation surface drives the condensate to migrate to the surrounding pipe wall and accelerate the reflux speed of the condensate; at the same time, due to the omission of the wick structures on the upper and lower surfaces, the thermal resistance is reduced, the evaporation and condensation speed is strengthened, and the heat exchange performance of the evaporation zone and the condensation zone is improved, thereby improving the heat exchange performance of the entire flat heat pipe. Since the reflux drive of the working fluid relies on the difference in wetting gradient and capillary force, the flat heat pipe of the present invention can better demonstrate its superior heat transfer performance under the condition of microgravity.

The foregoing description is only to illustrate the technical ideas of the present invention, and is not intended to limit the scope of protection of the present invention. Any changes or modifications made on the basis of the technical solutions according to the technical ideas proposed by the present invention shall fall within the scope of protection of the appended claims of the present invention.

What is claimed is:

1. A flat heat pipe having a gradient wetting structure, comprising a bottom plate, a top plate, and a support plate located between the bottom plate and the top plate, wherein the support plate comprises two support plates, and the bottom plate, the top plate and the two support plates on both sides are connected to form a seal chamber; a micron-level radial strip is processed on an inner surface of the bottom plate, presenting a wetting gradient that changes uniformly from a center to the circumference of a circle, which is used to transport liquid and collect condensate without a pump in the direction of a center of the circle; the inner surface of the top plate is processed with superhydrophilic and superhydrophobic radial structures arranged at intervals to transport the condensate to a direction of a surrounding pipe wall; and a wick is arranged on the inner side of the support plate.

2. The flat heat pipe having the gradient wetting structure according to claim 1, wherein the wick is a porous structure that is sintered on the inner side of the support plate by a sintering method; upper and lower ends of the wick are connected to the top plate and the bottom plate respectively.

3. The flat heat pipe having the gradient wetting structure according to claim 1, further comprising a plurality of support columns arranged between the bottom plate and the top plate, wherein upper and lower ends of the support columns are connected to the top plate and the bottom plate respectively.

4. The flat heat pipe having the gradient wetting structure according to claim 3, wherein the plurality of support columns are uniformly distributed between the bottom plate and the top plate.

5. The flat heat pipe having the gradient wetting structure according to claim 1, wherein the bottom plate, the top plate and the support plate are connected by welding and sealing.

6. The flat heat pipe having the gradient wetting structure according to claim 1, wherein an area of a superhydrophobic zone is larger than the area of the superhydrophilic zone in the radial structure of the inner surface of the top plate.

7. The flat heat pipe having the gradient wetting structure according to claim 6, wherein a ratio of surface area of superhydrophilic zone to the superhydrophobic zone is 1:5.

8. The flat heat pipe having the gradient wetting structure according to claim 1, wherein a height of a convex micron-level radial strip on the inner surface of the bottom plate and a distance between adjacent micron-level radial strips meet a requirement of being capable of holding up droplets to ensure a Cassie-Baxter state of the surface.

9. The flat heat pipe having the gradient wetting structure according to claim 1, wherein the micron-level radial strip on the inner surface of the bottom plate is prepared by photolithography.

10. The flat heat pipe having the gradient wetting structure according to claim 8, wherein the micron-level radial strip on the inner surface of the bottom plate is prepared by photolithography.

* * * * *